United States Patent [19]

Prutkovsky et al.

[11] 4,057,966

[45] Nov. 15, 1977

[54] STEAM-GAS POWER PLANT

[76] Inventors: Evgeny Nikolaevich Prutkovsky, ulitsa Kronshtadskaya, 24, kv. 24; Mikhail Albertovich Bermatov, ulitsa Bukharestskaya, 33, korpus 2, kv. 192; Evgeny Alexandrovich Tarasov, ulitsa Kapitana Voronina, 8, kv. 4; Valery Ilich Ozerov, ulitsa Savushkina, 26, kv. 7, all of Leningrad; Alexandr Fedorovich Fedosjuk, ulitsa Pavlova, 13, kv. 28; Vladimir Andreevich Krokhin, ulitsa Mendeleeva, 34, kv. 4, both of Nevinnomyssk Stavropolskogo kraya, all of U.S.S.R.

[21] Appl. No.: 604,077

[22] Filed: Aug. 12, 1975

[51] Int. Cl.[2] ..... F02C 7/02; F01K 7/34

[52] U.S. Cl. ..... 60/678; 60/39.18 B

[58] Field of Search ..... 60/39.18 B, 658, 678; 122/1 C, 7 R

[56] References Cited

U.S. PATENT DOCUMENTS

| | | | |
|---|---|---|---|
| 3,667,217 | 6/1972 | Vidal et al. | 60/39.18 B |
| 3,691,760 | 9/1972 | Vidal et al. | 60/39.18 B |
| 3,742,708 | 7/1973 | Vidal et al. | 60/678 |

*Primary Examiner*—Carlton R. Croyle
*Assistant Examiner*—L. J. Casaregola

[57] ABSTRACT

A gas-steam power plant comprising a gas-water low-pressure heat exchanger, low-pressure regeneration pre-heaters of which some are connected in the condensate line in parallel with the low-pressure gas-water heat exchanger and a device for preventing boiling of the condensate in the low-pressure gas-water heat exchanger. Said device comprises a main having one of its ends communicated with the line of outlet of the heated condensate from the low-pressure gas-water heat exchanger and the opposite end communicated with the line of condensate inlet of one of the regeneration low-pressure pre-heaters, located along the flow of the condensate upstream of the low-pressure regeneraton pre-heaters connected in the condensate line in parallel with the low-pressure gas-water heat exchanger.

6 Claims, 3 Drawing Figures

STEAM-GAS POWER PLANT

The present invention relates to power industry and, more particularly, it relates to steam-gas power plants.

The invention can be utilized to utmost advantage in steam-gas power plants operable within a broad range of power generator loads, particularly in the varying-load part of the operational duty of the power generator.

The known steam-gas plant includes a gas turbine unit, a steam generator disposed upstream of the gas turbine which is the last one in the direction of the flow of the gas, a steam turbine unit, an economizer and a plurality of gas-water heat exchangers. The furnace of the steam generator, as well as the evaporation and steam superheating surfaces thereof are subjected to the high pressure of the combustion products, as high as 3 to 20 atm. gauge.

The gas turbine unit comprises a compressor mounted on the same shaft with the gas turbine and a combustion chamber. The last-mentioned turbine transmits rotation to the power generator. The compressor producing compressed air is connected to the steam generator furnace and to the furnace of the combustion chamber, fuel being combusted in these furnaces of the steam generator and of the combustion chamber. The combustion products of the steam generator furnace are used to evaporate feed water within the evaporation surfaces of the steam generator and also to produce superheated steam within the superheating surfaces of this steam generator, this superheated steam being directed into the turbine of the steam turbine unit. The combustion products of the combustion chamber and the gases leaving the steam generator are directed into the gas turbine. Downstream of the gas turbine there are arranged in succession in the direction of the flow of the gases the economizer and high- and low-pressure gas-water heat exchangers. Having heated up the feed water in the economizer and in the high-pressure gas-water heat exchanger, as well as the condensate in the low-pressure gas-water heat exchanger, the gases escape into atmosphere.

The steam turbine unit of the plant of the prior art comprises a steam turbine from which steam is directed into a condenser. The latter is connected along the condensate line with low-pressure regeneration or heat-utilization pre-heaters. Some of the low-pressure pre-heaters along the condensate line are connected in parallel with the low-pressure gas-water heat exchanger. The low-pressure regeneration pre-heater which is the last one along the flow of the condensate and the low-pressure gas-water heat exchanger in the condensate line are connected with a deaerator. The deaerator is connected along the feed water line with the high-pressure regeneration pre-heaters. A pump is included into the feed water line intermediate the deaerator and the high-pressure pre-heaters, the latter being connected in the feed water line in parallel with the high-pressure gas-water heat exchanger. The high-pressure regeneration pre-heater which is the last one along the flow of the feed water and the high-pressure gas-water heat exchanger are connected to the economizer which, in its turn, is connected in the feed water line with the evaporation surfaces of the steam generator.

In the abovespecified gas-steam power plant of the prior art the condensate is heated up, as follows:

by the succession of the serially connected low-pressure pre-heaters of which the foremost one is connected to the condenser and the endmost one is connected to the high-pressure pre-heaters;

by the low-pressure gas-water heat exchanger which is connected along the condensate line in parallel with some of the pre-heaters, with the exception of at least one low-pressure pre-heater, which is the foremost one along the flow of the condensate.

The feed water is heated up:

by the succession of serially connected high-pressure pre-heaters of which the foremost one is connected via the pump with the deaerator, the latter being connected in series with the low-pressure preheater which, in its turn, is connected with the economizer;

by the high-pressure gas-water heat exchanger which is connected in the feed water line in parallel with the high-pressure pre-heaters;

by the economizer which is connected in the feed water line in series with the flow of the water coming from the high-pressure gas-water heat exchanger and from the high-pressure pre-heaters.

In known steam-gas power plants with a superposed gas turbine the steam generator is arranged downstream of the gas turbine which is the last one in the direction of the gas flow.

In arrangements of this type the power at the gas turbine shaft is provided by the heat of combustion of the fuel in the combustion chamber of the gas turbine.

The air compressor is connected to the furnace of the combustion chamber wherein fuel is combusted, the combustion products being fed to the gas turbine.

In the gas line the steam generator, the economizer, the high-pressure gas-water heat exchanger, the low-pressure gaswater heat exchanger form a succession of serially connected heat transfer units of which the foremost one is arranged downstream of the steam superheating surfaces of the steam generator and the endmost one exhausts into atmosphere.

In this arrangement the combustion products leaving the gas turbine enter the furnace and the heating surfaces of the steam generator, therefore, are subjected to relatively low gauge pressure, about 0.1 to 0.3 atm. gauge.

The condensate and the feed water are heated up in the same succession of steps which have been described hereinabove.

When a steam gas plant operates with partial load of the power generator, the operational duty which is optimal from the point of view of thermal economy is the one when permanent temperature of gas upstream of the gas turbines and permanent temperature of steam upstream of the steam turbines are maintained.

In steam-gas power plants with a superposed gas turbine this duty is effected by permanently maintaining an excess air ratio in the combustion chambers of the gas turbine unit. In steam gas plants wherein the steam generator is arranged upstream of the gas turbine this duty is effected by the combustion chamber connected in parallel with the steam generator in the gas line.

The operation of steam-gas power plants of the abovespecified types is characterized by reduced consumption of steam for regeneration or utilization of the steam coming from the steam turbine, as compared with the operation of a steam turbine in a traditional steam turbine power plant.

With varying steam output of the steam generator, i.e. with varying fractional load of the power plant the quantity of heat supplied for heating the condensate in the low-pressure gas-water heat exchanger remains practically permanent, whereas the quantity of water flowing through the low-pressure gas-water heat exchanger is substantially reduced.

To maintain economical operational duty of the steam-gas plant, the rate of supply of water to the low-pressure regeneration pre-heaters, connected in the condensate line in parallel with the low-pressure gas-water heat exchanger, is reduced, while the rate of supply of water to the low-pressure gas-water heat exchanger is maintained practically permanent. At a specified rate of steam consumption, e.g. 60% to 70% of the rated steam consumption, the last-mentioned regeneration pre-heaters are completely cut off, and the entire flow of water is directed into the low-pressure gas-water heat exchanger. With the power output of the plant reduced still further, the rate of flow of the condensate through the low-pressure gas-water heat exchanger is also reduced, and water begins boiling in this exchanger. This phenomenon affects the process of de-aeration and, consequently, results in corrosion of the screening tubes of the evaporation and steam superheating surfaces, in building up of the temperature of the walls of these tubes, caused by deposition of ferrous oxides, whereby the conditions of heat exchange are effected, which might even lead to rupture of the tubes of the heat exchange surfaces of the steam generator. In other words, boiling of water in the low-pressure gas-water heat exchanger affects reliability of the performance of the steam-gas power plant.

Known in the art are various methods of preventing boiling of water in the low-pressure gas-water heat exchanger of steam-gas power plants. One of such methods is reduction of the supply of the heat of the combustion products into the gas-water heat exchanger, which can be achieved by reducing either the temperature or the rate of feed of the gases at the inlet of the low-pressure gas-water heat exchanger. The first way involves reduction of the rate of feed of the fuel to the combustion chamber and, hence, reduction of the temperature of gases supplied to the gas turbine, which affects the thermal economy of the steam-gas plant by reducing the electric power output of the gas turbine unit. The other way involves bleeding of some amount of the gases to atmosphere, by-passing the low-pressure gas-water heat exchanger. However, this also affects the economy of the plant on account of increased heat losses caused by bleeding the combustion products into atmosphere. Therefore, reduction of the supply of heat to the low-pressure gas-water heat exchanger brings down the efficiency factor of the steam-gas power plant.

There are also known steam-gas power plants wherein boiling of water in the low-pressure gas-water heat exchanger is prevented by incorporation of means providing for feeding through this exchanger the required quantity of the condensate and recirculating the excessive volume of the condensate through the condenser of the steam turbine.

In one known plant of the last-described type the means preventing boiling of the condensate in the low-pressure gas-water heat exchanger is in the form of a main having one of its ends connected to the line of outlet of the heated condensate from the low-pressure gas-water heat exchanger and the other of its ends connected to the condenser of the steam turbine. The communication includes a pump and a valve controlling the rate of flow of the condensate.

Thus, the rate of flow of the condensate through the low-pressure gas-water heat exchanger is controlled by this control valve operated by control pulses in accordance with the temperature of the condensate at the inlet of the deaerator.

A disadvantage of the above arrangement of the known steam-gas power plant is an increased amount of irreversible power losses in the condenser, which affects the thermal economy of operation of the steam-gas power plant at fractional loads.

It is an object of the present invention to step up the thermal economy of a steam-gas power plant operated at loads short of the rated value, with prevention of boiling of the condensate in the low-pressure gas-water heat exchanger.

With this and other objects in view, the present invention resides in a steam-gas power plant comprising a low-pressure gas-water heat exchanger, low-pressure regeneration preheaters of which some are connected in the condensate line in parallel with the low-pressure gas-water heat exchanger, and means for preventing boiling of the condensate in the low-pressure gas-water heate exchanger, comprising a main having one of its ends communicated with the outlet line of the heated condensate coming from the low-pressure gas-water heat exchanger, in which plant, in accordance with the present invention, the opposite end of the main is communicated with the line of inlet of the condensate into one of the low-pressure regeneration pre-heaters, arranged in the line of the condensate upstream of the low-pressure regeneration pre-heaters connected in the line of the condensate in parallel with the low-pressure gas-water heat exchanger.

With the provision of the said main there is excluded boiling of the condensate in the low-pressure gas-water heat exchanger by feeding therethrough the amount of the condensate preventing such boiling, in excess of the flow rate of the condensate determined by the required supply of steam to the steam turbine, and that with reducing at the same time the irreversible losses of heat in the condenser. The excessive amount of the condensate heated in the low-pressure gas-water heat exchanger is by-passed via this main into the inlet line of one of the low-pressure regeneration pre-heaters, arranged along the flow of the condensate upstream of the regeneration low-pressure preheaters connected in the condensate line in parallel with the low-pressure gas-water heat exchanger, i.e. into the inlet line of one of the regeneration pre-heaters, arranged upstream of the point where the condensate is branched off into the low-pressure gas-water heat exchanger.

An increased thermal efficiency of the steam-gas plant is achieved, owing to increased power output of the steam turbine, resulting from reduced consumption of the steam by the low-pressure regneration pre-heaters arranged in the condensate heating line intermediate the point of connection of the herein proposed main with the inlet line of the said one regeneration preheater and the point of branching off or extraction of the condensate into the low-pressure gas-water heat exchanger. This is due to the increased temperature of the water at the inlet of these regeneration pre-heaters, thanks to mixing of the condensate heated by the low-pressure gas-water heat exchanger with the cooler condensate at the inlet of the foremost (in the direction of flow of the condensate) one of the last-mentioned pre-heaters.

It is expedient that the main should be provided with a pump for recirculation of the heated condensate through the low-pressure gas-water heat exchanger and a control valve downstream of the pump in the flow of the condensate.

The pump mounted in the main overcomes the hydraulic resistance of the excessive amount of the condensate directed through this main, while the control valve ensures that the amount of the condensate bypassed via this main is that in excess of the amount of feed water required by the steam generator.

It is desirable, that the pump should be incorporated into the condensate line via which some of the low-pressure regeneration pre-heaters are connected in parallel with the low-pressure gas-water heat exchanger, while the control valve should be included into the said communication.

Said arrangement of the pump in the circuitry of the steam-gas plant improves its operating conditions, since in this arrangement the pump operates with the cooler fluid, which prolongs the service life of the pump.

Other objects and advantages of the present invention will be made apparent in the following description of embodiments thereof, with reference being had to the accompanying drawings, wherein.

Figure 1:
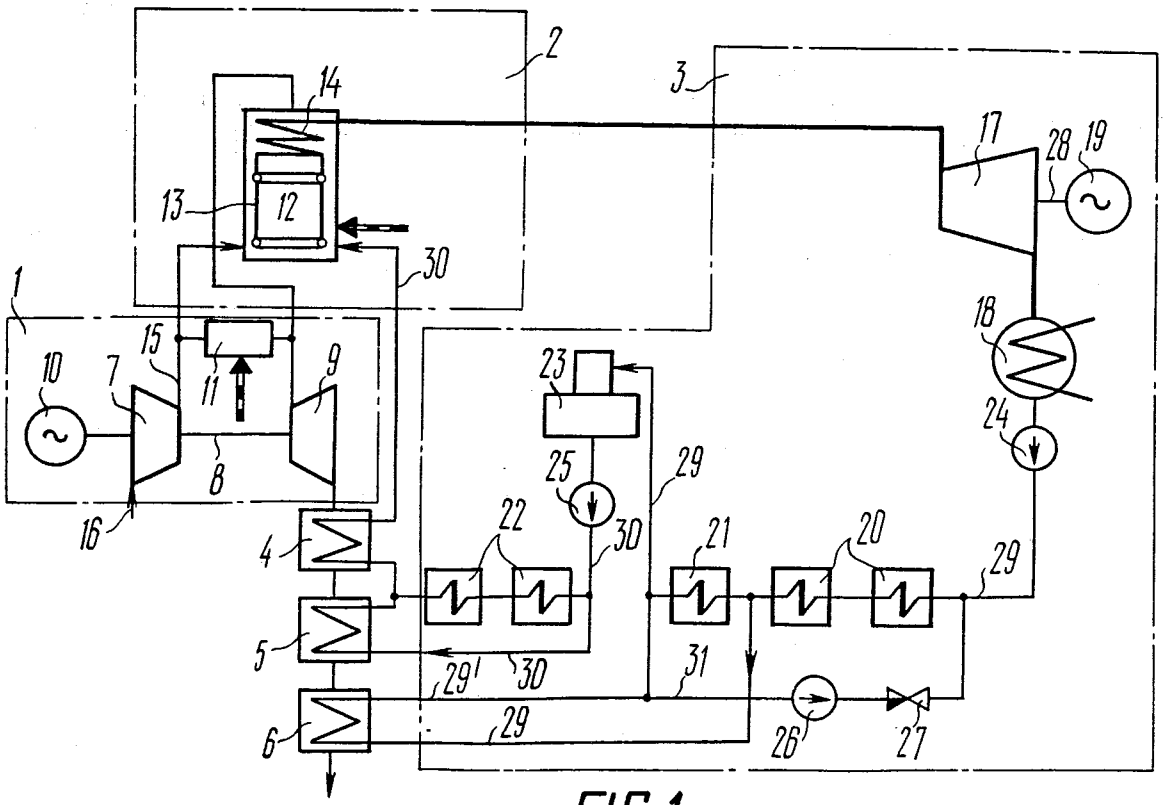
FIG. 1 is a schematic flow diagram of a steam-gas turbine with the steam generator arranged in front of the gas turbine, which is the endmost one in the direction of the gas flow, embodying the invention.

Referring now in particular to the appended drawings, the steam-gas power plant with the steam generator arranged upstream of the gas turbine, which is the endmost one in the direction of the gas flow, includes a gas turbine unit 1 (FIG. 1), a steam generator 2, a steam turbine unit 3, an economizer 4 and gas-water heat exchangers, viz. a high-pressure gas-water heat exchanger 5 and a low-pressure gas-water heat exchanger 6.

The gas turbine unit 1 comprises a compressor 7 mounted on the same shaft 8 with a gas turbine 9 and a power generator or alternator 10, as well as a combustion chamber 11.

The steam generator 2 comprises a furnace 12, evaporation surfaces 13 and steam superheating surfaces 14 which are subjected to the high pressure of the combustion products, as high as 3 to 20 atm. gauge.

The air compressor 7 is connected via a compressed air line 15 to the furnace 12 of the steam generator 2 and to the furnace of the combustion chamber 11, the suction line 16 of the air compressor 7 communicating with atmosphere. Fuel is combusted in the furnace 11 and 12. The combustion products of the furnace 12 of the steam generator 2 are used to evaporate the feed water within the evaporation surfaces 13 and thereafter are used to produce superheated steam within the superheating surfaces 14. The combustion products of the combustion chamber 11 and the gases leaving the steam generator 2 are fed to the gas turbine 9. Downstream of the gas turbine in the direction of the gas flow there are successively arranged the economizer 4, the high-pressure gas-water heat exchanger 5 and the low-pressure gas-water heat exchanger 6. After having heated up the feed water in the economizer 4 and in the high-pressure gas-water heat exchanger 5, as well as the condensate in the low-pressure gas-water heat exchanger 6, the gases escape into the atmosphere. The steam turbine unit includes a steam turbine 17 from which the steam is directed into the condenser 18, an electric generator or alternator 19 and a series of regeneration or heat-utilization pre-heaters, viz. low-pressure pre-heaters 20, 21 and high-pressure pre-heaters 22, as well as a deaerator 23, a condensate supply pump 24, a feed water supply pump 25, a pump 26 effecting recirculation of the heated condensate through the low-pressure gas-water heat exchanger and a control valve 27. The steam turbine 17 is mounted on the same shaft 28 with the alternator 19. The condenser 18 is connected via a condensate line 29 to the low-pressure regeneration pre-heater. Some of the low-pressure regeneration pre-heaters 21 are connected in the condensate line 29 in parallel with the low-pressure gas-water heat exchanger 6. The endmost low-pressure pre-heater 21 in the direction of the condensate flow and the low-pressure gas-water heat exchanger 6 are connected via the condensate line 29 to the deaerator 23. The latter is connected via a feed water line 30 to the high-pressure regeneration preheaters 22. The feed water line 30 includes the pump 25 intermediate the deaerator 23 and the high-pressure regeneration preheaters 22, the latter being included in the feed water line 30 in parallel with the high-pressure gas-water heat exchanger 5. The gas-water heat exchanger 5 and the endmost high-pressure pre-heater 22 in the direction of the feed water flow are connected to the economizer 4 which is connected via the feed water line 30 to the evaporation surfaces 13 of the steam generator 2.

To prevent boiling of the condensate in the low-pressure gas-water heat exchanger 6, there is incorporated a main 31 which has one end thereof connected with the outlet line 29' via which the heated condensate exits from the low-pressure gas-water heat exchanger 6 and the other end thereof connected to the point in the condensate line 29, which is the inlet of one of the low-pressure pre-heaters 20, arranged upstream of the low-pressure pre-heaters 21 in the direction of the condensate flow, i.e. upstream of the point of extraction of the condensate into the low-pressure gas-water heat exchanger 6. The main 31 in the presently described embodiment is provided with the pump 26 effecting recirculation of the heated condensate through the low-pressure gas-water heater exchanger 6 and the control valve 27.

Figure 2:
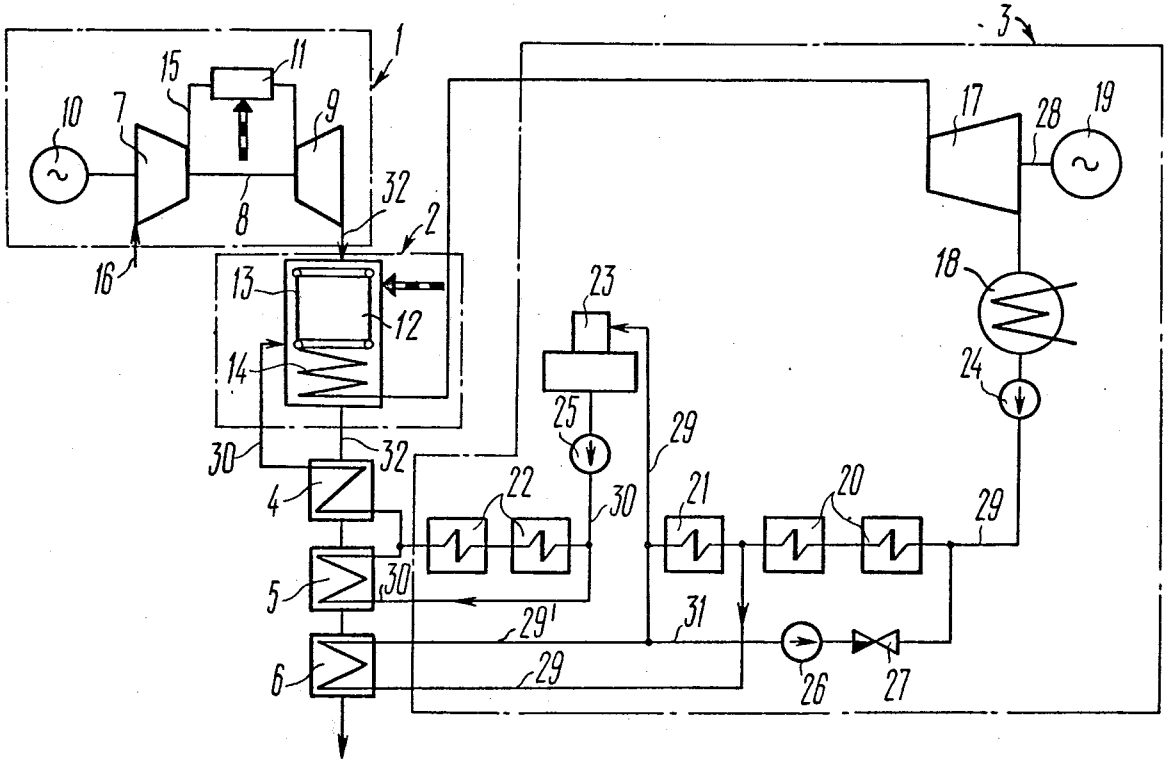
FIG. 2 is a schematic flow diagram of a steam-gas plant with a superposed gas turbine, according to the invention.

The steam gas plant with the superposed gas turbine, illustrated schematically in FIG. 2, is different from the steam-gas plant wherein the steam generator is upstream of the end-most gas turbine in the direction of the gas flow, in the following respects.

The compressor 7 in the plant illustrated in FIG. 2 is connected via the compressed air line 15 solely to the furnace of the combustion chamber 11, the combustion products being supplied to the gas turbine 9.

The exhaust gas line 32 of the gas turbine 9 is connected to the furnace 12 of the steam generator 2. In this arrangement the power at the shaft of the gas turbine 9 is produced by the heated obtained by combustion of the fuel in the combustion chamber 11 of the gas turbine 9.

In the gas line 32 the steam generator 2, the economizer 4, the high-pressure gas-water heat exchanger 5 and the low-pressure gas-water heat exchanger 6 form a serial connection of heat-transfer devices of which the first one (4) is downstream of the steam superheating surfaces 14 of the steam generator 2 and the last or endmost one (6) exhausts into atmosphere.

In this embodiment the combustion products leaving the gas turbine 9 are directed into the furnace 12 and onto the heat exchanger surfaces 13 and 14, i.e. the heating surfaces of the steam generator 2, which are thus subjected to relatively low gauge pressure, about 0.1 to 0.3 atm. gauge. The condensate and the feed water are heated up in the same succession of steps. which has been described hereinabove in connection with the plant illustrated in FIG. 1.

The steam-gas power plant embodying the envention, illustrated in FIG. 1, operates at fractional loads along the gas and air lines, as follows.

Air sucked in by the compressor 7 is compressed therein and directed into the furnace 12 of the steam generator 2 and into the furnace of the combustion chamber 11. Fuel is fed into both furnaces, the air-to-fuel ratio in both furnaces being selected to provide the rated gas parameters at the inlet of the gas turbine 9 and the rated steam parameters at the inlet of the steam turbine 17, at the actual load of the steam turbine 17. The gases leaving the heating surfaces 13, 14 of the steam generator 2 and the gases coming from the combustion chamber 11 are mixed and jointly directed into the gas turbine 9 to produce work there. This work is spent on rotation of the air compressor 7 and of the alternator 10. The energy of the gases exhausted by the gas turbine 9 is utilized in the serially arranged economizer 4, the high-pressure gas-water heat exchanger 5 and the low-pressure gas-water heat exchanger 6, whereafter the gases escape into atmosphere.

The steam-gas power plant embodying the invention, illustrated in FIG. 2, operates at fractional loads along the gas and air lines, as follows.

Air sucked in by the compressor 7 is compressed therein and directed into the combustion chamber 11 into which fuel is also fed. With the load of the steam turbine 17 being reduced, the excess air ratio in the combustion chamber 11 practically does not vary, whereby the gases directed from the combustion chamber 11 into the gas turbine 9 have parameters equalling those of the rated duty. The gases work in the gas turbine 9 to rotate the compressor 7 and the alternator 10. The exhaust gases of the turbine 9 are directed into the furnace 12 of the steam generator 2, into which fuel is also fed. The products of combustion successively yield their heat at the evaporation and superheating heat transfer surfaces 13 and 14, respectively, at the economizer 4, the high-pressure gas-water heat exchanger 5, the low-pressure gas-water heat exchanger 6, wherefrom the gases escape into atmosphere.

At loads short of the rated value, i.e. at fractional loads the steam-gas plants illustrated both in FIG. 1 and in FIG. 2 operate along the feed water and condensate lines, as follows.

The combustion products are directed onto the evaporation and steam superheating heat transfer surfaces 13 and 14, respectively, of the steam generator 2. The steam produced within the steam superheating surfaces 14 is directed into the steam turbine 17 which rotates the alternator 19. The exhaust steam of the steam turbine 18 is directed into the condenser 18 to be condensed therein, the condensate being withdrawn from the condenser 18 by the pump 24 via the condensate line 29 into the regeneration low-pressure preheaters 20, 21. At loads short of the rated one by 60% to 70% the low-pressure pre-heaters 21 are cut off, and the condensate is directed into the low-pressure gas-water heat exchanger 6 via the condensate line 29 in a quantity required to prevent boiling therein.

The last-mentioned quantity being in excess of the rate of feed of water required to ensure the predetermined supply of the steam to the turbine 17, the excessive condensate is by-passed downstream of the low-pressure gas-water heat exchanger 6 via the main 31 by the recirculation pump 26 through the control valve 27 back into the condensate line 29, to the point upstream of the low-pressure preheaters 20. The rest of the condensate is directed via the condensate line 29 into the deaerator 23, wherein the condensate is de-aerated. From the deaerator 23 the feed water is directed along the line 30 by the pump 25 into high-pressure pre-heaters 22 and the high-pressure gas-water theat exchanger 5, connected in parallel, whereafter the feed water is directed into the economizer 4 and into the evaporation and steam-superheating surfaces 13 and 14, respectively, of the steam generator 2.

Figure 3:
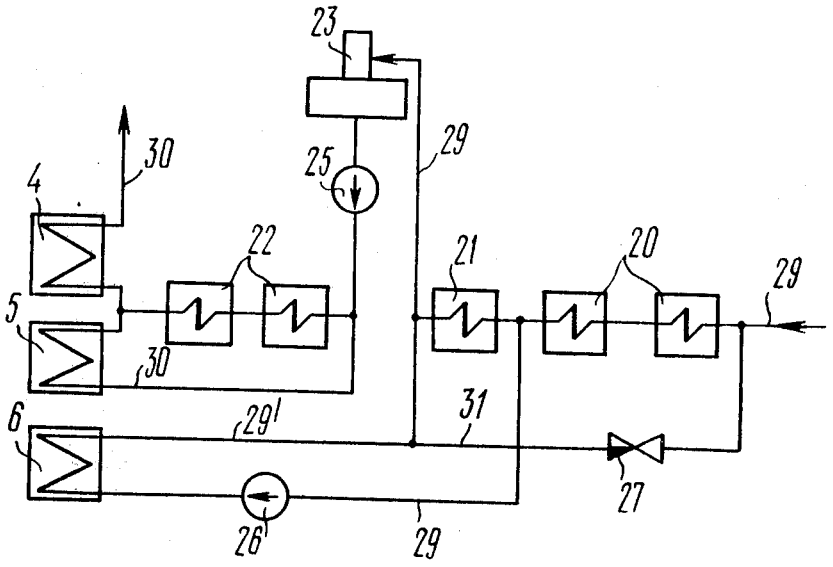
FIG. 3 illustrates one of possible ways of including the condensate recirculation pump into the circuitry of a steam gas plant, embodying the invention.

There is illustrated in FIG. 3 of the appended drawings a modification of the arrangement of the pump 26 effecting recirculation of the condensate through the low-pressure gas-water heat exchanger 6, the pump being included into the condensate line 29 at the inlet of the heat exchanger 6. With the pump arranged in the circuit of the steam-gas power plant in this manner, the operating conditions of the pump are improved, since in this case the pump 26 handles the cooler fluid, which prolongs the service life of the pump.

What is claimed is:

1. A steam-gas power plant comprising: a condensate line; a condenser in said line, a pump in said line downstream of the condenser, a low-pressure gas-water heat exchanger for heating the condensate; a line of outlet of the condensate from said low-pressure gas-water heat exchanger; low-pressure regeneration pre-heaters connected in series in said condensate line, some of said low-pressure regeneration preheaters being connected in said condensate line in parallel with said low-pressure gas-water heat exchanger; a line of inlet of the condensate into said regeneration low-pressure pre-heaters; means for preventing boiling of the condensate in said low-pressure gas-water heat exchanger, including a main having one end thereof connected to said line of outlet of the condensate from said low-pressure pressure gas-water heat exchanger and the other end thereof connected to said line of inlet of the condensate into one of said regeneration low-pressure pre-heaters downstream of said pump, arranged along the flow of the condensate upstream of said low-pressure regeneration pre-heaters which are connected in said condensate line in parallel with said low-pressure gas-water heat exchanger.

2. A steam-gas power plant as set forth in claim 1, comprising: a pump for recirculating the heated condensate through said low-pressure gas-water heat exchanger, in said main; and a control valve provided in said main, arranged downstream of said pump along the flow of the condensate.

3. A steam - gas power plant as set forth in claim 1, comprising:

a pump for recirculating the heated condensate through said low-pressure gas-water heat exchanger, said pump being included in said condensate line along which said regeneration low-pressure pre-heaters are connected in parallel with said low-pressure gas-water heat exchanger;

a control valve provided in said main.

4. A steam-gas power plant as set forth in claim 2 wherein said low pressure pre-heaters include a plurality of series connected heaters with an endmost pre-heater, said other end of said main being connected to the series of pre-heaters upstream of the endmost one.

5. A steam-gas power plant as set forth in claim 4 comprising a conduit connecting said main at the outlet of said gas-water heat exchanger with the outlet of one of the intermediate preheaters and the inlet of the next successive preheater, and a deaerator in said conduit.

6. A steam-gas power plant as set forth in claim 5 comprising a pump in said conduit.

* * * * *